United States Patent [19]

Marthaler et al.

[11] Patent Number: 4,927,052

[45] Date of Patent: May 22, 1990

[54] GOLF BALL PACKAGE, HOLDER AND DISPENSER

[76] Inventors: Robert H. Marthaler, 942 Sycamore La., Bartlett, Ill. 60103; Gregory A. Marthaler, 1969 Dorset Dr., Wheaton, Ill. 60187

[21] Appl. No.: 267,925

[22] Filed: Nov. 7, 1988

[51] Int. Cl.[5] ..... B65D 83/00

[52] U.S. Cl. ..... 221/64; 221/24; 221/185; 221/307; 221/309; 224/918; 224/919

[58] Field of Search ..... 221/64, 303, 307, 309, 221/304, 24, 185, 199, 281; 224/251, 252, 269, 274, 918, 919; 211/14, 15; 273/32 D, 201; 206/315.9, 497; 312/49

[56] References Cited

U.S. PATENT DOCUMENTS

| | | | |
|---|---|---|---|
| 2,768,775 | 10/1956 | Houser | 221/309 |
| 3,047,140 | 7/1962 | Robins | 206/315.9 |
| 3,306,493 | 2/1967 | Szajna | 221/64 |
| 3,430,809 | 3/1969 | Vanstrom | 221/64 |
| 4,082,209 | 4/1978 | Sanders | 221/309 X |
| 4,106,678 | 8/1978 | Thomas | 221/309 X |
| 4,296,874 | 10/1981 | Evans | 221/307 |
| 4,610,373 | 9/1986 | Sherbondy | 221/303 X |

*Primary Examiner*—Joseph J. Rolla
*Assistant Examiner*—David H. Bollinger

[57] ABSTRACT

A golf ball package, holder and dispenser with a cylindrical plastic molded base or sleeve, a replaceable plastic cover, and a deformable dispensing hole in the base side.

The base is a one-piece plastic molding and the aperture is formed with an elliptical shape in the molding without additional parts.

11 Claims, 3 Drawing Sheets

GOLF BALL PACKAGE, HOLDER AND DISPENSER

BACKGROUND OF THE INVENTION

The commercial golf equipment and accessories marketplace is known to be replete with novelty items utilizing various golf themes to promote dissimilarly functioned articles. For example, golf club heads or facsimilies thereof are sold as paperweights, cuff links and tie clasps. Similarly, various caricatures of golf bags have been utilized to function other than to hold golf clubs, for example, as wastebaskets and cane and umbrella holders.

It has also been suggested in the past that a short metallic tube be provided to dispense golf balls that can be carried with the golfer's bag around the course. These tubes usually include some separate metal clip on the bottom to hold the balls in the tube and permit the balls to be selectively removed when desired from the bottom of the tube.

Insofar as I am aware however, a one-piece plastic ball holder and dispenser has not been devised in the past and particularly not one that is capable of also functioning as the retail packaging for a sleeve of three balls.

It is, therefore, the primary objecting of the present invention to ameliorate the problems noted above in packaging, holding and after-purchase dispensing of a sleeve of golf balls.

SUMMARY OF THE PRESENT INVENTION

In accordance with the present invention, a golf ball package, holder and dispenser device is provided that consists of a one-piece plastic molded base or sleeve with a replaceable plastic cover and deformable lower side opening that when relaxed is elliptical and holds the balls in the base and when squeezed becomes circular permitting the lower ball to exit the hole or opening.

The base has a snap-lock top cover that completes the package and also serves to hold a plurality of tees in vertical positions after the original sale. An integral clip is provided on the side that permits the base and cover to be clipped to the top of the user's bag for convenient use as the golfer travels around the course.

One of the principal advantages of the present invention is that the base and the cover with three balls in the base can be wrapped with the clear cellophane film and sold as a sleeve of balls through conventional retail golf ball marketing channels. When so wrapped it can also be utilized as a premium item to be given away to golfers at the first tee in amateur tournament play.

Other objects and advantages of the present invention will appear more clearly from the following detailed description.

DETAILED DESCRIPTION OF THE PREFERRED EMBODIMENT

Figure 1:
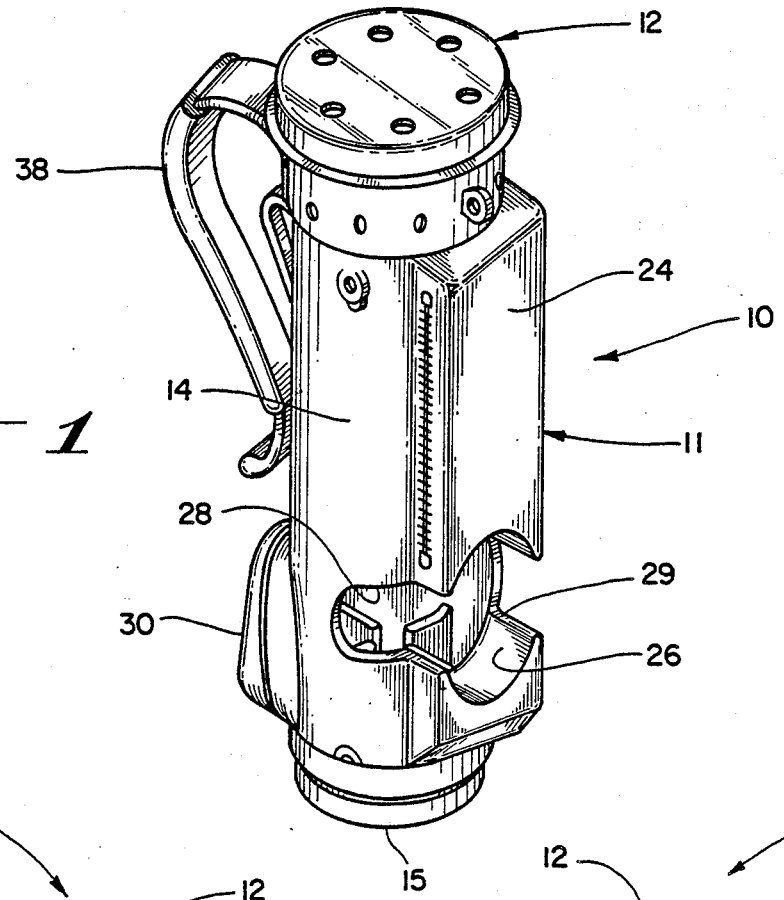
FIG. 1 is a perspective view of the present golf ball package, holder and dispenser.
Figure 2:
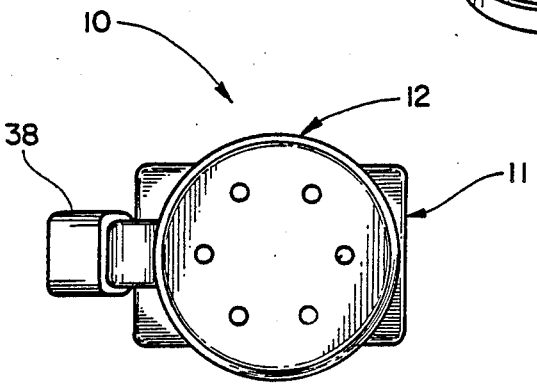
FIG. 2 is a top view of the golf ball package illustrated in FIG. 1.
Figure 3:
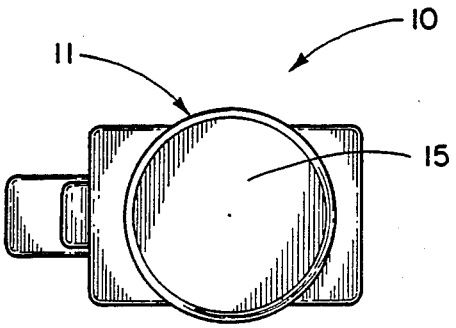
FIG. 3 is a bottom view of the golf ball package illustrated in FIGS. 1 and 2.
Figure 4:
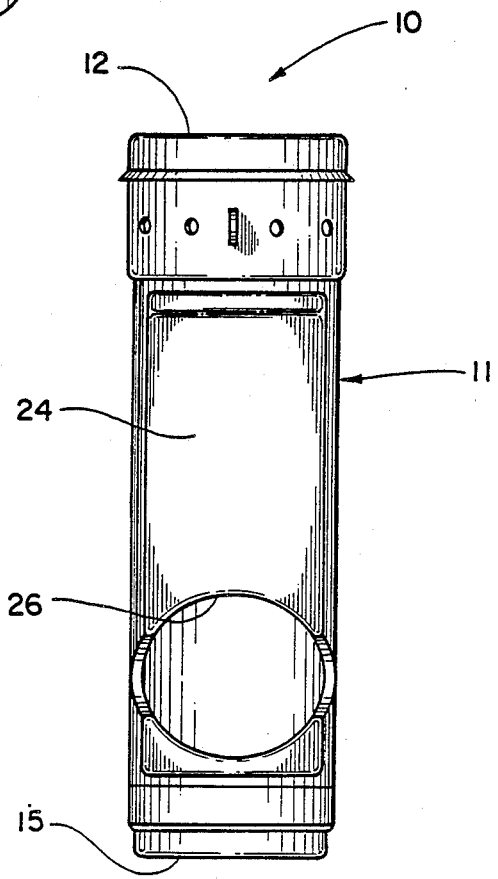
FIG. 4 is a front view of the golf ball package illustrated in FIG. 1.
Figure 5:
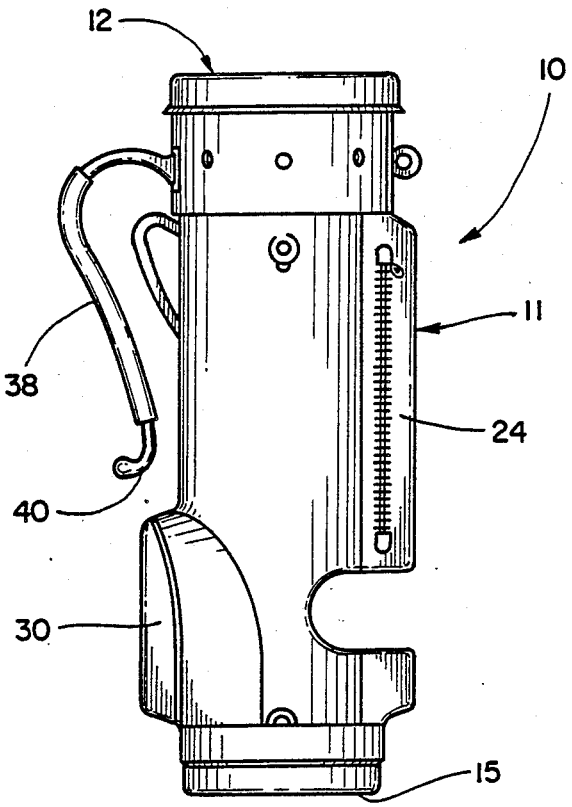
FIG. 5 is a left side view of the golf ball package illustrated in FIG. 1.
Figure 6:
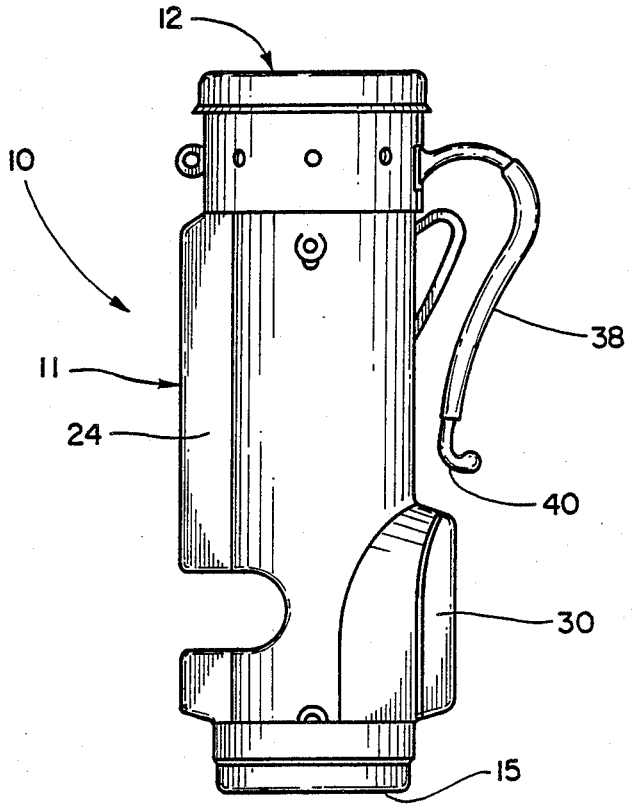
FIG. 6 is a right side view of the golf ball package illustrated in FIG. 1.
Figure 7:
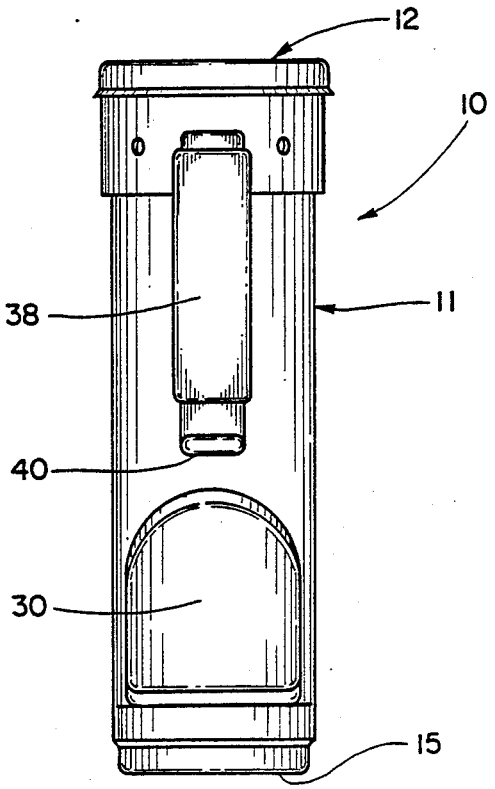
FIG. 7 is a rear view of the golf ball package illustrated in FIG. 1.

Referring to the drawings and particularly in FIGS. 1 to 7, a golf ball package, holder and dispenser is illustrated generally indicated by the reference numeral 10 and is seen to include a one-piece plastic molded base or sleeve 11 and a one-piece plastic molded top or cover 12. As is apparent from the drawings, the base 11 generally takes the cosmetic form of a miniature caricature of a golf bag and it should be understood the non-functional aspects of the base 11 contributing to its appearance as a golf bag form no part of the present invention and are in fact the subject of our co-pending design application U.S. Ser. No. 303,392 filed Jan. 30, 1989 entitled Golf Ball Package Design.

Both the base 11 and cover 12 are formed of a durable somewhat flexible plastic such as polypropylene.

Figure 10:
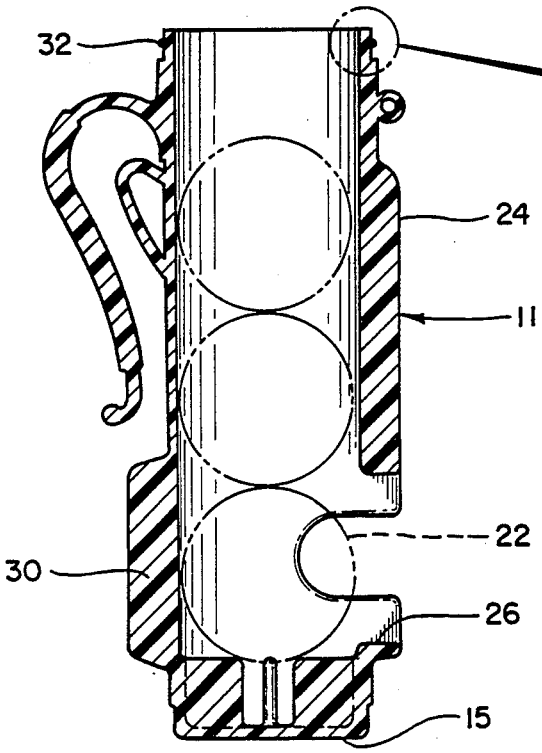
FIG. 10 is a longitudinal section through the base sub-assembly with the cover removed.
Figure 12:
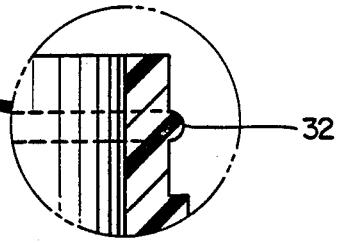
FIG. 12 is a fragmentary section of the top of the base taken generally in the circle illustrated in FIG. 10.
Figure 13:
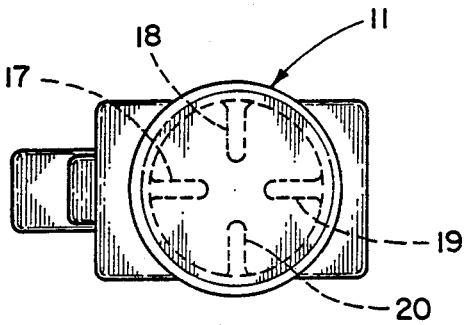
FIG. 13 is a bottom view of the base showing the ball supporting radial projections.

The base 11 includes a generally cylindrical portion 14 having an integral closed bottom wall 15 (also see FIG. 10) having four integral radial projections 17, 18, 19 and 20 projecting upwardly therefrom. As shown in FIGS. 10 and 13 they engage and support lower ball 22 of the three balls in the base 11. The base has sufficient length to hold three balls in the configuration illustrated in FIG. 10 with some clearance at the top so that the present package 10 can be utilized as a substitute for a three ball sleeve-type package which is normally rectangular as will be apparent to those familiar with golf ball marketing.

The base has a forwardly extending projection 24 that is solid as indicated in FIG. 10 except for an elliptical opening 26 therein at the lower end of the base having a horizontal central axis. The base 11 has finger slots 28 and 29 that facilitate ball removal.

The rear of base 11 has an integral rearwardly extending projection 30 that also is solid as indicated in FIG. 10 and diametrally opposite the solid forward extending projection 24 which affects the ball dispensing function as will appear hereinafter.

The upper end of cylindrical base 11 has a small annular flange 32 therearound that fits within a complementary annular recess 34 in the inside of cap 12 so that cap 12 may be releasably snap-locked to base 11.

As seen in FIGS. 1 to 8 and 9, cap or cover 12 has an annular array of six tee receiving holes therein that receive and hold tees 37 when the package 10 is in use by the consumer after removal of outer cellophane wrap that encircles and packages the base 11 and cap 12. Note the clearance between the upper ball illustrated in FIG. 10 and cover 12 permits the tees 37 to extend within the base 11 without interference with the upper ball.

The base 11 includes an integral "S" shaped clip 38 having a downwardly rearwardly curved end 40 that facilitates clip opening as it engages the top of the golfer's bag as he clips package and dispenser 10 to the top of the bag. The spring flexibility of clip 38 assures that the base 11 will be firmly held against the user's golf bag as it travels the bumpy road around the course.

Figure 14:
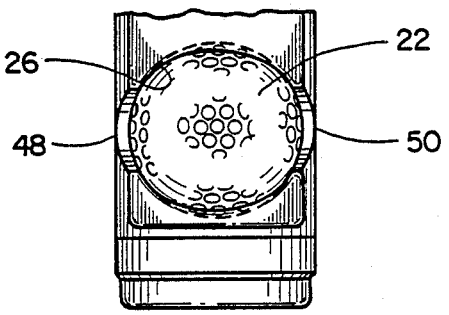
FIG. 14 is a fragmentary front view of the lower part of the base showing the relaxed elliptical ball dispensing opening.

As seen in FIG. 14, opening 26 in the forward projection 24 is slightly elliptical in configuration and sized so that it has a major horizontal diameter somewhat greater than the diameter of a standard American sized golf ball and a vertical minor diameter somewhat less than the diameter of this standard ball. In this way the lower ball 22 is prevented from exiting the base 11. An important aspect of the present invention is that the elliptical configuration of aperture or hole 26 is not the result of the tool core for hole 26 because it is in fact cylindrical, but instead a result of the differential wall thickness between thin wall portions 48 and 50 in the base adjacent the sides of aperture 26 and the thick wall portions of projections 24 and 30 and their diametral positions as seen in FIG. 10.

Figure 15:
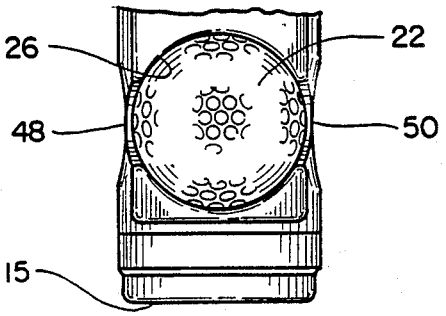
FIG. 15 is a lower fragmentary view of the base similar to FIG. 14 with the sides of the base squeezed and the dispensing aperture circular.
Figure 8:
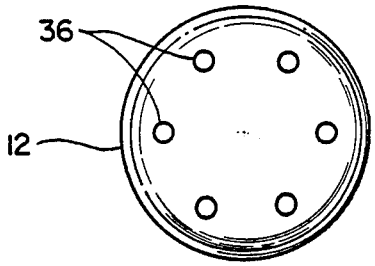
FIG. 8 is a top view of the cover sub-assembly.
Figure 9:
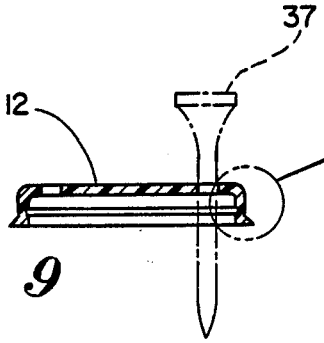
FIG. 9 is a diametral cross-section of the cover illustrated in FIG. 8.
Figure 11:
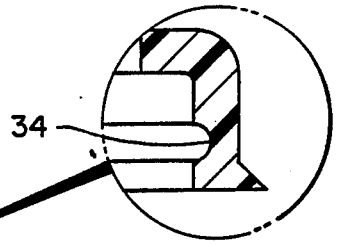
FIG. 11 is an enlarged fragmentary section taken generally in the circle illustrated in FIG. 9.

The thin wall portions 48 and 50 are sufficiently flexible, as seen in FIG. 15, so that the user grasps the thin wall portions 48 and 50 with his thumb and index finger and squeezes these walls, they bend inwardly forcing hole 26 to become circular in configuration with a diameter slightly larger than the diameter of the standard ball. By squeezing walls 48 and 50 slightly rearwardly of the center of the lower ball, the lower ball will be forced forwardly through aperture 26 into the golfer's hand without any difficult manipulations.

In this way balls 22 are held firmly in the base 11 without any additional clips or other parts and yet the balls can be easily removed by the golfer.

I claim:

1. A golf ball package and dispenser, comprising: a one-piece plastic molded base adapted to receive a plurality of golf balls, having a generally cylindrical configuration with a closed bottom end and an open top end adapted to receive a plurality of golf balls, means for closing the open end of the base, and means for dispensing the golf balls adjacent the closed end of the base, said dispensing means including a side aperture in the base adjacent the closed end, said aperture being shaped to normally retain the golf balls in the base, said aperture being constructed to be deformable to permit removal of the golf balls through the aperture, said aperture being formed entirely in the one-piece base without additional ball retaining parts.

2. A golf ball package and dispenser as defined in claim 1, wherein the means for closing the open end of this base is a one-piece plastic molded cover, and a plurality of tee receiving openings therein integrally formed in the cover.

3. A golf ball package and dispenser as defined in claim 1, including three golf balls in the base, and a thin flexible clear plastic wrap for the base, cover means and balls so the package is complete for sale.

4. A golf ball package and dispenser as defined in claim 1, including an integral spring clip on the base so the base can be attached to a golf bag or belt.

5. A golf ball package and dispenser, comprising: a one-piece plastic molded base adapted to receive a plurality of golf balls, having a generally cylindrical configuration with a closed bottom end and an open top end adapted to receive a plurality of golf balls, means for closing the open end of the base, and means for dispensing the golf balls adjacent the closed end of the base, the dispensing means including a side aperture in the base adjacent the closed end, said aperture being shaped to normally retain the golf balls in the base, said base being flexible in an area adjacent the aperture and constructed when manually squeezed to modify the aperture shape to permit dispensing the golf balls from the base.

6. A golf ball package and dispenser, comprising: a one-piece molded base adapted to receive a plurality of golf balls, having a generally cylindrical configuration with a closed bottom end and an open top end adapted to receive a plurality of golf balls, means for closing the open end of the base, and means for dispensing the golf balls adjacent the closed end of the base, said dispensing means including a side aperture in the base adjacent the closed end, said aperture being shaped to normally retain the golf balls in the base, said base being flexible in an area adjacent the aperture and constructed to vary the aperture shape to permit dispensing the golf balls from the base.

7. A golf ball package and dispenser as defined in claim 6, wherein there is formed a pair of slots in the base connected to the aperture to facilitate ball removal from the base.

8. A golf ball package and dispenser as defined in claim 6, wherein the base has at least one diametrally opposite substantially thicker section adjacent the aperture to cause the aperture to assume an elliptical configuration having a major axis when the base is relaxed and a generally circular configuration when the base is manually squeezed along the major axis.

9. A golf ball package and dispenser as defined in claim 6, wherein the aperture is elliptical to hold the balls in the base, said base being constructed so that when squeezed the aperture becomes generally circular to permit ball removal.

10. A golf ball package and dispenser, comprising: a one-piece molded base adapted to receive a plurality of golf balls, having a generally cylindrical configuration with a closed bottom end and an open top end adapted to receive a plurality of golf balls, means for closing the open end of the base, means for dispensing the golf balls adjacent the closed end of the base, said dispensing means including a side aperture in the base adjacent the closed end, said aperture being shaped to normally retain the golf balls in the base, said base being flexible in an area adjacent the aperture and constructed when manually squeezed to modify the aperture shape to permit dispensing the golf balls from the base, said base having at least one diametrally opposite substantially thicker section adjacent the aperture to cause the aperture to assume an elliptical configuration with a major axis when the base is relaxed and a generally circular configuration when the base is manually squeezed along the major axis, said means for closing the open end of this base being a one-piece plastic molded cover, and a plurality of tee receiving openings integrally formed in the cover.

11. A golf ball package and dispenser as defined in claim 10, including three golf balls in the base, and a thin flexible clear plastic wrap for the base, cover means and balls so the package is complete for sale.

* * * * *